US005416794A

United States Patent [19]

Cignetti et al.

[11] Patent Number: 5,416,794

[45] Date of Patent: May 16, 1995

[54] INDUCTION FURNACE HAVNG A MODULAR INDUCTION COIL ASSEMBLY

[75] Inventors: Nicolas P. Cignetti, North Canton, Ohio; Hans G. Heine, Red Bank, N.J.

[73] Assignee: Inductotherm Corp., Rancocas, N.J.

[21] Appl. No.: 107,427

[22] Filed: Aug. 16, 1993

Related U.S. Application Data

[63] Continuation-in-part of Ser. No. 19,921, Feb. 19, 1993, which is a continuation-in-part of Ser. No. 532,010, Jun. 1, 1990, Pat. No. 5,272,720, which is a continuation-in-part of Ser. No. 473,000, Jan. 31, 1990, Pat. No. 5,275,281.

[51] Int. Cl.[6] ..... H05B 6/22

[52] U.S. Cl. ..... 373/153; 373/143; 373/151

[58] Field of Search ..... 373/138–139, 373/144–152, 156, 153, 143

[56] References Cited

U.S. PATENT DOCUMENTS

| | | | |
|---|---|---|---|
| 2,852,587 | 9/1958 | Junker | 373/153 |
| 2,929,906 | 3/1960 | Connelly | 219/10.79 |
| 3,004,091 | 10/1961 | Tama et al. | 373/153 |
| 3,303,258 | 2/1967 | Junker | 373/153 |
| 3,703,601 | 11/1972 | Babel | 373/163 |
| 3,704,336 | 11/1972 | Synnestvedt | 373/152 |
| 4,411,412 | 10/1983 | Lechevallier | 266/242 |
| 4,618,864 | 10/1986 | Larson et al. | 373/155 |
| 4,622,679 | 11/1986 | Voss | 373/152 |
| 4,969,158 | 11/1993 | Larson et al. | 373/152 |
| 5,257,281 | 10/1993 | Cignetti et al. | 373/155 |
| 5,272,720 | 12/1993 | Cignetti et al. | 373/155 |

FOREIGN PATENT DOCUMENTS

| | | |
|---|---|---|
| 0053070 | 6/1982 | European Pat. Off. . |
| 0152849 | 8/1985 | European Pat. Off. . |
| 0232846 | 8/1987 | European Pat. Off. . |
| 2368542 | 5/1978 | France . |
| 2559573 | 8/1985 | France . |
| 2127333 | 12/1971 | Germany . |
| 2313157 | 9/1974 | Germany . |
| 1036782 | 7/1966 | United Kingdom . |
| 1451287 | 9/1976 | United Kingdom . |

OTHER PUBLICATIONS

Hanas et al., *Asea Journal*, vol. 41, No. 2–3, "Recent developments and future trends in coreless induction furnaces" pp. 32–35 (1968).

US Patents Fulltext 1971–1979, U.S. Pat. No. 3,883,678, Hegewaldt et al., issued Mar. 05, 1974.

Patent Abstracts of Japan, vol. 5, No. 112 (M-79) 21 Jul. 1981 & JP-A-56 053 868 (Fuji Denki Seizo K.L.) 13 May 1981.

*Primary Examiner*—Bruce A. Reynolds
*Assistant Examiner*—Tu Hoang
*Attorney, Agent, or Firm*—Seidel Gonda Lavorgna & Monaco

[57] ABSTRACT

An induction furnace is disclosed comprising a crucible for holding a material to be heated by the furnace, an induction coil assembly, and a module-support assembly surrounding and radially supporting the induction coil assembly so as to facilitate the replacement and reconnection of the induction coil assembly. The induction coil assembly comprises an induction coil, an upper yoke, a lower yoke, and a plurality of intermediate yokes that are spaced apart from each other. The induction coil is wound around the crucible and defines the periphery of the induction furnace. The intermediate yokes are arranged to extend around substantially all of the periphery defined by the wound induction coil. The upper and lower yokes are electromagnetically coupled together by the plurality of intermediate yokes. The module-support assembly has upright members and shaft members that allow each of the plurality of intermediate yokes to be separately removed from the furnace while the other intermediate yokes remain in place and to allow for the induction coil assembly to be removed from the furnace in its entirety.

10 Claims, 5 Drawing Sheets

INDUCTION FURNACE HAVNG A MODULAR INDUCTION COIL ASSEMBLY

CROSS-REFERENCE TO RELATED APPLICATIONS

This is a continuation-in-part application of application Ser. No. 08/019921 filed, Feb. 19, 1993, which is a continuation-in-part of application Ser. No. 07/532,010, filed on Jun. 1, 1990, now U.S. Pat. No. 5,272,720, which is a continuation-in-part of application Ser. No. 07/473,000, filed Jan. 31, 1990, now U.S. Pat. No. 5,275,281, the disclosures of each of which are incorporated herein by reference.

FIELD OF THE INVENTION

This invention relates to induction furnaces and, more particularly, to induction furnaces having an induction coil assembly that is structurally interconnected with the furnace in a modular manner. The modular induction coil assembly comprises a helical induction coil and segmented intermediate yokes that share the majority of the circumferential region covered by the helical induction coil. The modular structure facilitates fault isolation by allowing for the easy and convenient removal of either the segmented yokes or the assembly itself.

BACKGROUND OF THE INVENTION

Induction furnaces for melting metal by generating magnetic fields which induce eddy currents to flow within and heat the metal are well-known. In such furnaces, an induction coil assembly creates the magnetic fields. Induction coil assemblies are commonly considered to include an induction coil, and upper, lower and intermediate yokes. One such induction coil assembly is described in the already referenced U.S. patent application Ser. No. 08/019921, filed Feb. 19, 1993. The induction coil assembly of U.S. Ser. No. 08/019921, in most of its disclosed embodiments, surrounds but is separated from a crucible that holds the metal being heated. The induction coil assembly disclosed in that application comprises upper and lower yokes electromagnetically coupled together by intermediate yokes and all of such yokes cooperating with a helical induction coil that is wrapped around the crucible.

Because of the high power typically required to accomplish industrial-scale heating of the metal within the crucible, the induction coil assembly and its components are relatively large. A relatively large induction coil assembly is well-suited to its desired purpose, but its size becomes a disadvantage in the event of a fault condition. More particularly, if the induction coil assembly experiences a fault, an inordinate amount of time is typically required to disconnect and then reconnect the faulty component of the assembly, as well as the relatively large cables associated with delivering the high power to these components. The excessive disconnect and reconnect times directly contribute to excessive down time in which the associated induction furnace is removed from production.

An induction furnace having a replaceable coil assembly which facilitates its removal and replacement is known and is made available from Pillar Industries Limited Partnership of Menomonee Falls, Wis. as their "shunt pac design." The replaceable coil assembly is a one-piece unit having so-called stud board members which are circumferentially spaced apart from each other and which physically support the induction coil of the assembly. These stud board members limit the amount of circumference of the induction coil that can be covered by the intermediate yokes, because the intermediate yokes cannot be placed about the induction coil in those regions already occupied by the supporting stud board members. This limitation restricts the amount of the circumference of the induction coil covered by the intermediate yokes to a factor of between 50 to 60% of the total circumference of the wound induction coil. It is desired that means be provided so that the amount of the circumference of the induction coil covered by the intermediate yokes is increased from this 50–60% factor to that of about 80% or better.

Induction coil assemblies having provisions to allow for access to components to facilitate replacement thereof also have a drawback in that such access allows for debris to find its way into the interior of the induction coil assembly. Usually, this debris is metallic and it is created during the formation and/or pouring of the metal heated by the furnace. This metallic debris is typically attracted to the magnetic yokes and may move around within the induction coil assembly to cause ground fault. It is desired that the entrance of the debris into the interior be restricted, while at the same time still providing provisions to easily remove any such entered debris, especially if the debris finds its way into the general region of the intermediate yokes so that any related ground faults may be quickly cleared.

In addition to providing provisions to facilitate the removal of ground faults and also the removal of induction coil assemblies themselves, it is important that the induction furnace be substantially free of operational vibration noise. Such noise commonly manifests itself as a humming sound emanating from the induction furnace, in particular from the induction coil. This noise may be of particular annoyance to the operators of the furnace, especially when subjected to it over a long period of time. It is desired that means be provided to substantially reduce the noise emanating from the induction coil.

Accordingly, it is an object of the present invention to provide an induction coil assembly that is easily removed from the induction furnace yet has an arrangement wherein the vast majority of the circumference of the wound induction coil is covered by the intermediate yokes.

It is a further object of the present invention to provide an induction coil assembly that is easily removed and has provisions to allow any unwanted metallic debris to be conveniently moved from its confines, especially from the general regions of the intermediate yokes.

Further still, it is an object of the present invention to provide an induction furnace having an induction coil assembly with a modular arrangement that facilitates easy and quick removal of some of its intermediate yokes in the event of a fault so as to increase the overall availability and production time of the induction furnace while at the same time reduce the level of noise commonly emanating from the induction coil.

Other objects, advantages and novel features of the present invention will become apparent from the following detailed description of the invention when considered in conjunction with the accompanying drawings.

SUMMARY OF THE INVENTION

The present invention is directed to an induction furnace having an induction coil assembly which includes an induction coil and a plurality of yokes. The induction coil assembly is supported within the furnace by a mounting arrangement that accommodates its removal and replacement from the furnace. More particularly, the induction furnace has a module-support assembly for supporting the induction coil assembly so as to allow any one of a plurality of intermediate yokes of the induction coil assembly to be removed from the furnace while the other intermediate yokes remain in place. Furthermore, the module-support assembly allows for induction coil assembly to be removed in its entirety and remains in place awaiting for another assembly to be installed into the furnace.

The induction furnace comprises means for holding a material to be heated, an induction coil assembly, and a module-support assembly for supporting the induction coil assembly. The material being heated is held within a crucible having a predetermined shape. The induction coil assembly has a central axis, a preselected axial length, and a preselected inner diameter. The induction coil assembly comprises an induction coil, an upper yoke, a lower yoke, and a plurality of intermediate yokes. The induction coil is wound around the crucible and defines a periphery of the induction furnace. The intermediate yokes are arranged to extend around substantially all of the periphery defined by the induction coil. The upper and lower yokes are axially separated from each other by a predetermined distance and electromagnetically coupled together by the plurality of intermediate yokes. The module-support assembly surrounds and radially supports the induction coil assembly and includes upright members and shaft members.

The present invention also includes a method for supporting the induction coil assembly within an induction furnace having a crucible and for arranging the components of the induction coil assembly so as to reduce any stray flux that may be emitted therefrom. The method includes providing a particular arrangement including a coil assembly having at least an induction coil and a plurality of intermediate yokes, with the upper and lower yokes. The induction coil is wound around the crucible and defines a periphery of the induction furnace. The intermediate yokes are arranged to extend around substantially all of the periphery defined by the induction coil. The method also includes providing a plurality of upright members and a plurality of shaft members. The upright members are spaced apart from each other by a predetermined distance about the periphery of the induction furnace with each upright member having an aperture therein. The shaft members are each respectively fitted into the aperture of upright members. The shaft members are adapted to be moved radially inward and outward toward and away from the periphery of the furnace. The plurality of intermediate yokes are arranged around the induction coil, but separated therefrom by a piece of electrically insulative material. The plurality of intermediate yokes are located about the periphery of the induction furnace so that at least a portion of each yoke is in alignment with at least one of upright members. The shaft members are then adjusted to more radially inward so that each respectively contacts one of the plurality of intermediate yokes. It is preferred that the method further comprising the step of providing the upright members with arm members each having two oppositely-located apertures and with each aperture receiving a shaft member; each of the apertures being in alignment with different yet adjacent intermediate yokes.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENTS

Figure 1:
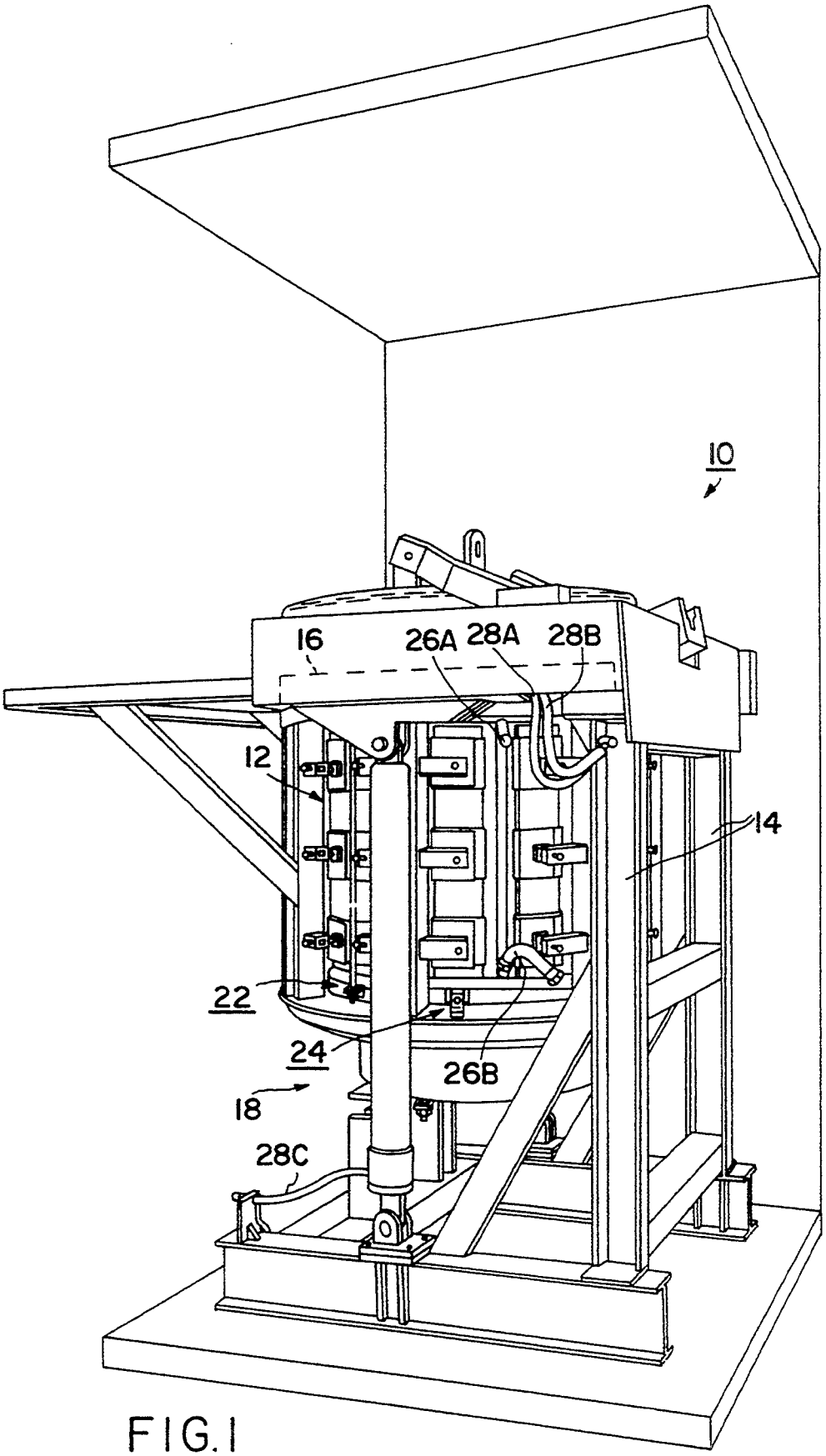
FIG. 1 illustrates an induction furnace according to the present invention.

Referring now to the drawings, wherein like reference numbers indicate like elements, there is shown in FIG. 1 an induction furnace 10 according to the present invention. The induction furnace 10 can have a diameter of up to several feet and a height also up to several feet. These dimensions are required in order to accommodate the melting of metal in such quantities as are commonly needed for industrial applications. Consequently, the components of the induction furnace 10, such as its induction coil assembly 12 as well as the cabling required to deliver high power to these components, all have relatively large dimensions.

In general, the induction furnace 10 provides for easy replacement of induction coil assembly 12 while also providing intermediate yokes of the induction coil assembly that are arranged in a modular manner so as to also allow for easy replacement thereof. Further, the induction coil assembly 12 has an arrangement wherein the majority of the circumference of its wrapped induction coil is covered by the intermediate yokes so as to substantially reduce any stray flux from being emitted by the induction coil assembly 12. Further still, the induction coil assembly 12 is arranged so that its modular-intermediate yokes may be easily removed to allow for the quick removal of metallic debris that may somehow find its way onto these intermediate yokes and possibly create ground faults. Moreover, the induction coil assembly is connected to hold-down members, has a prestressed induction coil, and has an internal structural arrangement of its components all of which cooperate so as to substantially reduce any vibration noise and EMF-radiation commonly emanating from the induction coil of the induction coil assembly 12.

The induction furnace 10 has a plurality of frame members 14 arranged for tilting support, a top portion 16 (shown in phantom), a lower portion 18 having a generally curved arrangement, and the induction coil assembly 12. The induction coil assembly 12, as will be further described, is provided with at least two or more tie-rod assemblies 22 and at least two or more clamp assemblies 24. The furnace 10 has combined power and water cooled conduits 26A and 26B, and fluid lines 28A, 28B and 28C that are routed to hydraulically controlled devices, such as the cover of the induction furnace 10. The power connection and cooling fluid within conduits 26A and 26B are delivered to the induction coil assembly 12, which is further described with reference to FIG. 2.

The induction coil assembly 12 completely surrounds a crucible 30 which holds the metal to be heated by the furnace 10. The crucible 30 comprises a monolithic liner formed of a refractory material and fired in place. The crucible 30 has a top region 30A that is adjacent to but separate from a plurality of refractory members 32 commonly arranged in cap-like segments about the periphery of the induction furnace 10. The crucible 30 has a bottom region 30B which is supported by the bottom portion 18.

The induction coil assembly 12 has a central axis 34, a preselected axial length and a preselected inner diameter. These dimensions are determined primarily by the amount of metal that the furnace 10 is designed to hold and melt. The induction coil assembly 12, as defined herein, comprises a helical induction coil 34, an upper yoke 36, a lower yoke 38 and a plurality of intermediate yokes 40. The induction coil 34 is wrapped around the periphery of the crucible 30 and, as to be more fully described, defines the periphery of the induction furnace 10 that is of importance to the present invention. Intermediate yokes 40 are separated from the induction coil 34 by an insulating sheet 42, preferably but not necessarily mica. Similarly, the induction coil 34 is separated from the crucible 30 preferably by means of a layer 44 of grout material. The induction coil 34 is separated from the upper and lower yokes 36 and 38 by means of insulating layers 46 and 48, respectively. The upper and lower yokes 36 and 38 are axially separated from each other by a preselected distance and are electromagnetically coupled to each other by the plurality of intermediate yokes 40.

The upper yoke 36 is located under the segmented refractory members 32 which are held in place by an annular metal member 50 joined to a lip portion 52 by means of a weld 54. The upper and lower yokes 36 and 38 are preferably cooled by means of cooling fluids flowing in cooling ducts 56 and 58, respectively. The upper and lower yokes 36 and 38 are laminated and are similar to the upper and lower yokes described in the previously mentioned U.S. patent application Ser. No. 08/019921, and to which reference may be made for further details of these yokes. The intermediate yokes 40 are of primary importance to the present invention and, because of a modular-support assembly 60 (to be described next), are capable of being separately removed from the induction coil assembly 12.

The module-support assembly 60 allows each of the plurality of intermediate yokes 40 to be separately and completely removed from the induction coil assembly 12 while the remaining yokes 40 stay in place. Furthermore, the induction coil assembly 12 and the crucible 30 may be removed in their entirety while the module support assembly 60 remains in place awaiting the installation of another induction coil assembly 12, which may have its refractory lining already in place. The module-support assembly 60 comprises a plurality of upright members such as post members 62, preferably a plurality of removable arm members 64, and a plurality of shaft or adjustment means 66. For the embodiments shown in FIG. 2, as well as that shown in FIGS. 3-6, the module-support assembly 66 comprises upper, middle and lower members, as most clearly shown in FIG. 2; however, for the sake of clarity, the associated reference numbers are only shown for the middle members.

Figure 2:
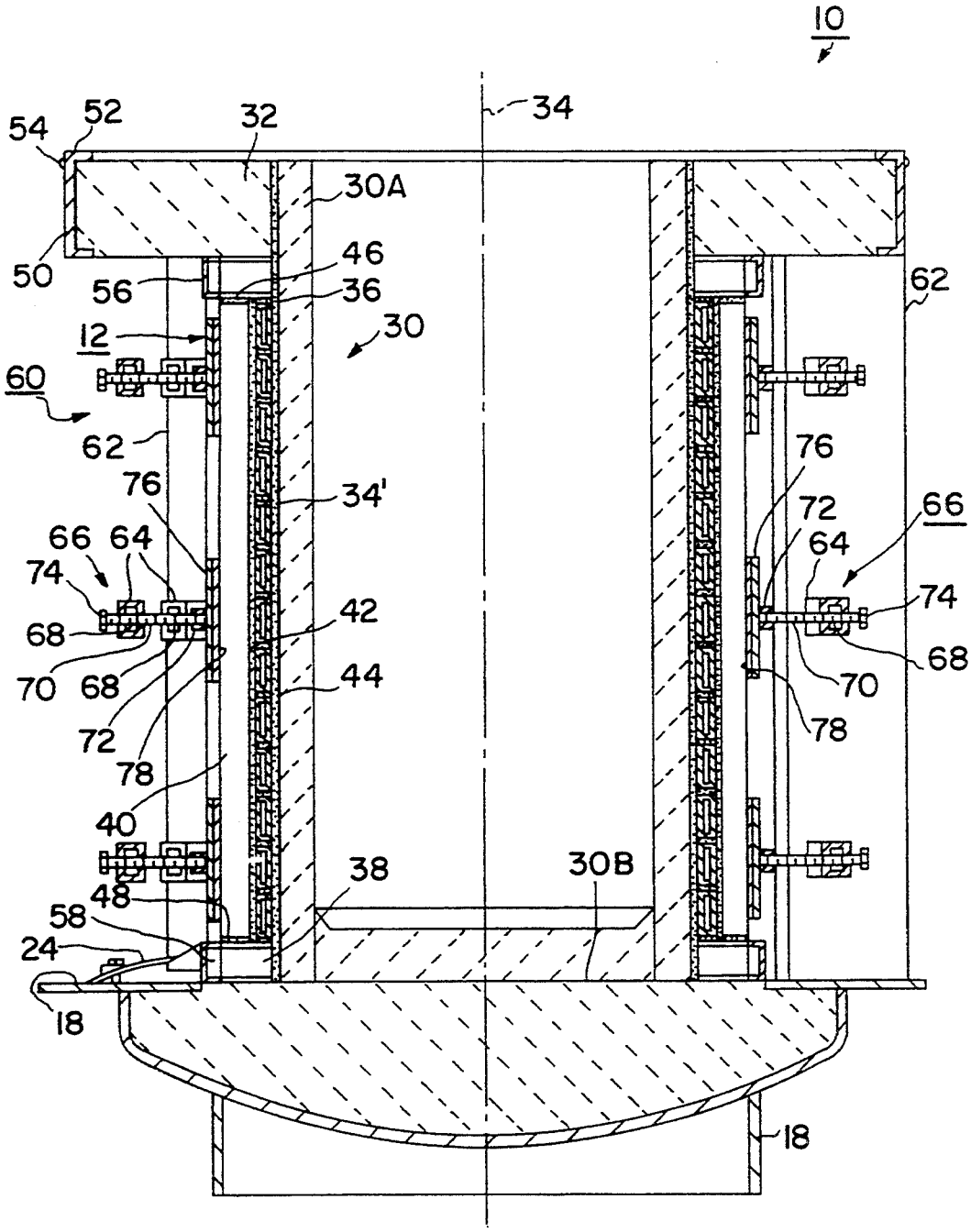
FIG. 2 is a transverse-sectional view of the induction furnace of FIG. 1 illustrating the induction coil assembly of the present invention.

Each of the removable arm members 64 of FIG. 2 is preferably hollow and has a central channel 68. Each arm member 64 has an aperture 68A into which is inserted a shaft or bolt 70 of the adjustment means 66. In one embodiment, the shaft 70 is threaded and fits into the aperture 68A having corresponding internal threads so that the shaft 70 is threadedly engaged within the aperture 68A. In another embodiment, to be discussed with reference to FIG. 6, aperture 68A is not threaded but defines a clearance hole for shaft 70. A nut and a conical disc spring are located within central channel 68 and cooperate with the shaft 70 to provide for radial expansion in response to the thermal expansion of an operating induction coil 34. The rotation of the shaft 70 in any direction, e.g. clockwise, causes the shaft 70 to move radially inward toward the center of the induction furnace 10 and, conversely, the rotation of the shaft 70 in the other direction, e.g. counterclockwise, causes the shaft 70 to move radially outward from the center of the induction furnace 10. The shaft 70 has one of its ends preferably insertable into a guide member 72 which, as will be further described, is indirectly connected to a respective intermediate yoke 40. The other end of shaft 70 has a grippable head 74 used for adjusting or moving the shaft 70 radially inward or outward. The shaft 70, when moved to its most inward position, cooperates with guide means 72 and clamping members 76 and 78 to hold the respective laminates in place within intermediate yokes 40, and to keep the intermediate yokes 40 pressed against the induction coil 34. The induction coil assembly 12 is rigidly held in place, in part, by clamp assembly 24 shown in FIG. 2 but which is illustrated in greater detail in FIG. 3.

Figure 3:
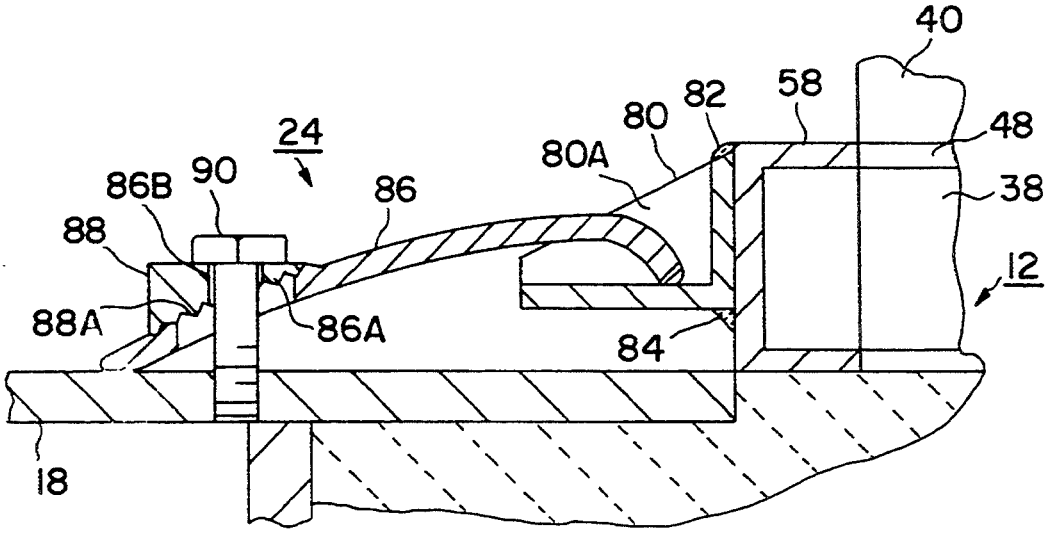
FIG. 3 illustrates a clamping arrangement that holds the induction coil assembly to the lower portion of the induction furnace.

FIG. 3 illustrates clamp assembly 24 as comprising elements 80, 86, 88 and 90. The element 80 is joined to the duct 58 by weldments 82 and 84. The duct 58 being rigidly attached (not shown) to the circular lower yoke, which is part of the induction coil assembly 12, thereby fixedly attaches the induction coil assembly 12 to the element 80. The element 80 in turn is rigidly attached to the lower support member 18 by means of elements 86, 88 and 90. Element 86 has a bowed shape and one of its ends is inserted into a recess 80A of element 80 and its other end is captured and clamped by elements 88 and 90. The element 88 has stepped edges 88A that engage complementary stepped edges 86A of element 86. The element 90 is inserted into a slot 86B in element 86 and has a threaded end that mates with complementary threads in the lower portion 18. As can be recognized from FIG. 3, as the element 90 is tightened downward, it presses downward onto element 88 which, in turn, presses downward onto bowed element 86 which, in turn, presses downward onto element 80 and, thereby, ensuring that the induction coil assembly 12 is rigidly held in place to the bottom portion 18. The support of induction coil assembly 12 by module-support assembly 60 may be further described with reference to FIG. 4.

Figure 4:
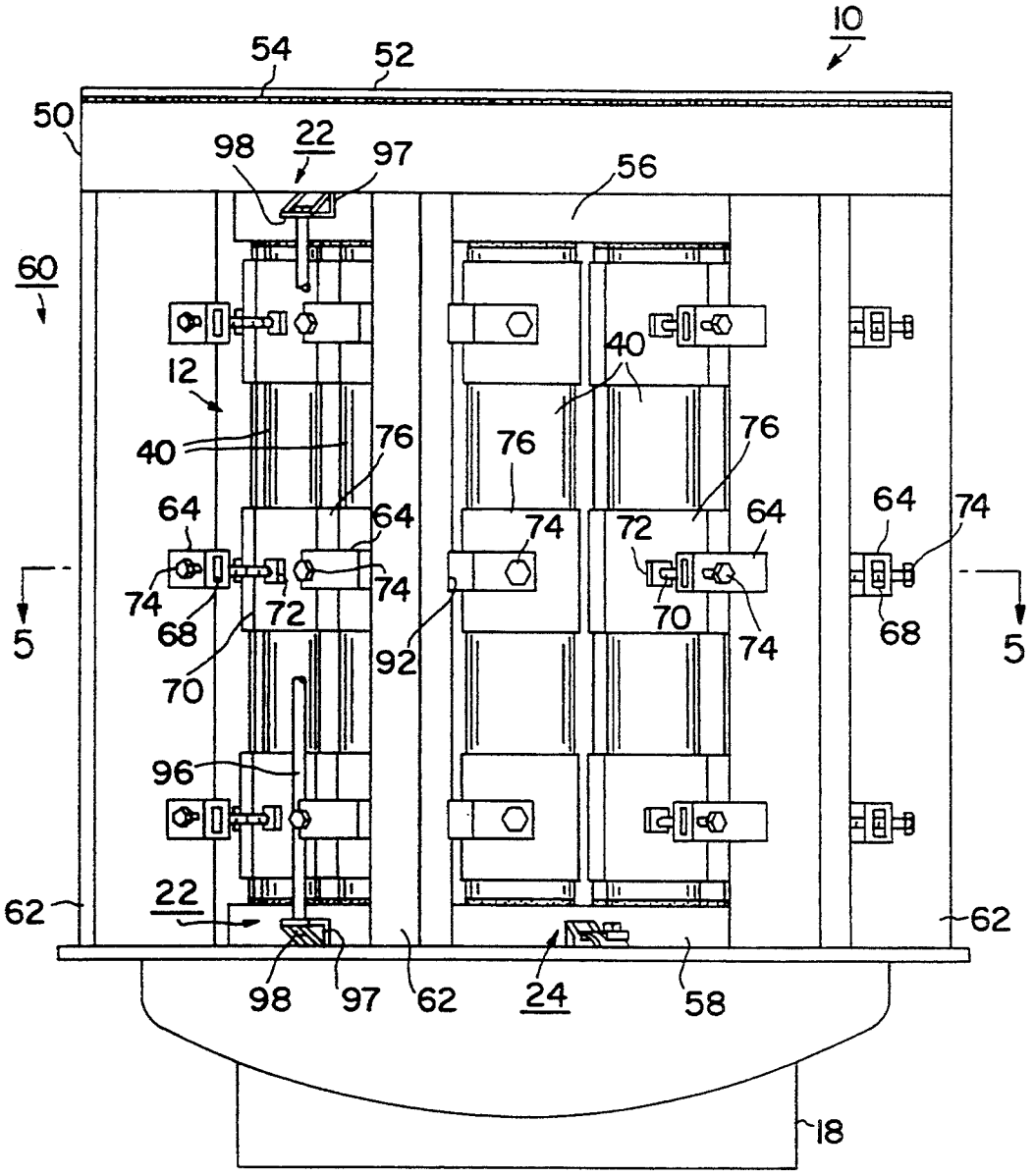
FIG. 4 illustrates the module-support assembly for supporting the induction coil assembly within the induction furnace.

FIG. 4 shows the plurality of post members 62 being connected between and circumferentially spaced apart around annular support member 50 and the lower portion 18. The post members 62 are affixed in a stationary manner to the housing of the induction furnace 10 so as to facilitate the removal and replacement of the induction coil assembly 12 in its entirety. More particularly, the affixed post members 62 allow the module support assembly 60 to remain stationary while the induction coil assembly 12 is removed in its entirety (to be discussed) and remains in place ready to accept and support a replacement induction coil assembly 12.

Each of the removable arm members 64 has dimensions selected to preferably fit snugly into transverse passageways 92 positioned, as shown in FIG. 4, at the upper, middle and lower regions of the post members 62. The dimensions of the arm members 64 are also selected so that they may be completely removed from passageways 92 to facilitate the removal of intermediate yokes 40 to be discussed hereinafter. Each of the removable arm members 64 preferably have two separate adjustment means 66 respectively connected to two different, but adjacent, vertically extending intermediate yokes 40. Such an arrangement allows each arm member 64 to assist in the support of an adjacent pair of intermediate yokes 40, but if desired, the arms 64 may be eliminated and each separate adjustment means 66 may be interconnected to individual post members 62 which are positioned in front of individual intermediate yokes 40.

FIG. 4 further shows a tie-rod assembly 22, also shown in FIG. 1, similar to that disclosed in the aforementioned U.S. patent application Ser. No. 08/019921. The tie-rod assembly 22 comprises a rod 96; a pair of hold-down members 97, respectively connected to ducts 56 and 58; a pair of nuts 98, one for each hold-down member 97; and a pair (not shown) of conical disc spring members respectively positioned under the nuts 98 so as to be in physical engagement with the respective opposite ends of the rod 96 and serving as thermal expansion means. Each of the conical disc spring member has sidewalls that bow outward in response to an applied force. Each of the nuts 98 is tightened onto a conical disc spring member causing that conical disc spring member to be forced against the respective hold-down member 97. The hold-down members 97 are attached to the induction coil assembly 12 by means of ducts 56 and 58 so that these hold-down members 97 are indirectly connected to the upper and lower yokes 36 and 38 (see FIG. 2) of the induction coil assembly 12.

In operation, and as to be more fully described, when the upper and lower yokes 36 and 38 begin to be axially displaced because of the thermal expansion of the operating induction coil 34, the spring-like sidewalls of the conical spring members become bowed so as to move outward with the thermally expanding induction coil 34. These conical disc members resiliently return to their original shape when the induction coil 34 returns to its non-expanded, non-operating condition. The conical disc spring members allow for axially clamping during all operating and non-operating conditions of the induction coil 34 of the induction coil assembly 12.

The tie-rod assembly 22, the clamping assembly 24 and the support assembly 60 in cooperation with the upper and lower yokes 36 and 38 advantageously provide means for axially compressing the induction coil 34 and such compression may be described with reference to both FIGS. 2 and 4. As can be seen in FIG. 2, the upper and lower yokes 36 and 38 respectively restrict the upper and lower movement of induction coil 34, whereas as can be seen in either FIGS. 2 or 4, the tie-rod assembly 22 restricts the movement of ducts 56 and 58 which in turn restrict the movement of upper and lower yokes 36 and 38, and clamp assembly 24 holds the induction coil assembly 12 to the lower portion 18. The induction coil 34 in its dormant or non-operation condition is held in place by elements 36, 38, 22 and 24 but, in a manner as previously mentioned, when the induction coil 34 is placed into its operational condition, the conical disc members of tie-rod assembly 22 advantageously allow for the thermal expansion of the induction coil 34.

In addition to such thermal expansion provisions, the present invention provides means to reduce vibration noise that is commonly emanating from the induction coil 34 in its operating condition. More particularly, the upper and lower yokes 36 and 38 are part of the support structure of the induction coil assembly 12 and provide clamping of the induction coil 34 to reduce its operational movement. Further, the induction coil 34 itself is preferably prestressed which reduces its axial movement commonly caused by the operation alternating magnetic field and the thermal expansion of the induction coil 34 itself. In particular, internal stresses are introduced into the induction coil 34 which more than counter the stresses that typically occur when the induction coil 34 is subjected to magnetic forces that would otherwise cause axial movement, vibration and noise. In addition, the intermediate yokes 40 pressing against the induction coil 34 because of the related shafts 70 being forced against clamp members 76 which, in turn, are forced against their related yoke 40, provides radial clamping of the induction coil 34 which cooperatively assists the action of the axial clamping provided by solid upper and lower yokes 36 and 38. The arrangement of the post members 62, arm members 64, and adjustment means 66 that includes the shafts 70 all of which provide the primary support of the induction coil assembly 12 may be further described with reference to FIG. 5, which is a view taken along line 5—5 of FIG. 4.

Figure 5:
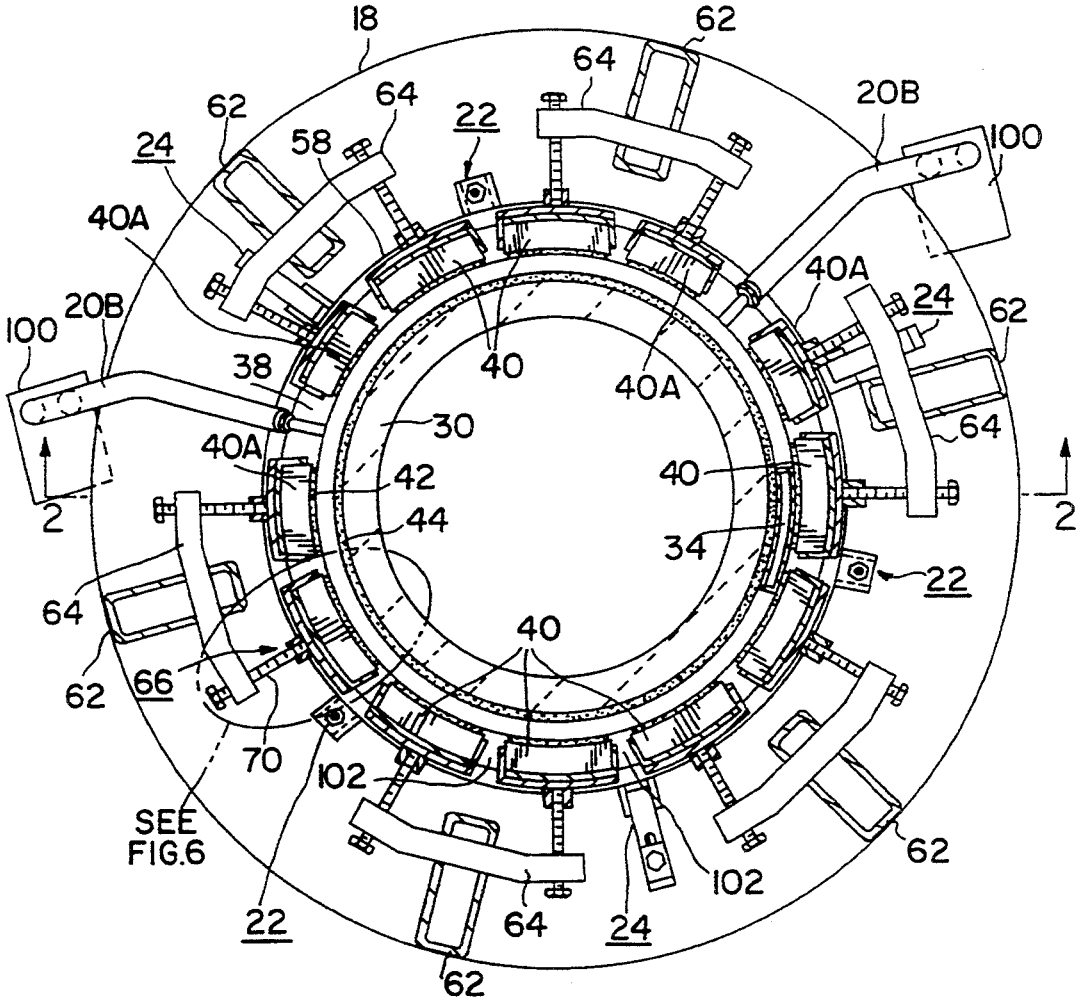
FIG. 5 is a view, taken along line 5—5 of FIG. 4, illustrating the arrangement of the post members of the module-support assembly relative to a respective pair of intermediate yokes.

FIG. 5 illustrates some of the intermediate yokes, shown as 40A, as having a width which is less than the width of the remaining yokes 40. These intermediate yokes 40A are provided to make room for and accommodate the interconnection of oppositely located water cooled electrical connections such as 20B, each having a junction box 100, to the helical induction coil 34 of the induction coil assembly 12. FIG. 5 further shows a plurality (three) of tie-rod assemblies 22 and a plurality (three) of clamp assemblies 24, all assemblies being spaced apart from each other.

For the embodiment shown in FIG. 5, twelve intermediate yokes 40 surround the induction coil 34 and are circumferentially spaced apart from each other. The intermediate yokes 40 are most often spaced apart from each other by a distance 102 shown in the bottom portion of FIG. 5. However, as further seen in FIG. 5, the separation between intermediate yokes 40A is increased, relative to distance 102, in the general area near the power connection and the cooling conduits, such as 20B, to the induction coil 34. Six post members 62 are located relative to a respective pair of intermediate yokes 40 with each post member 62 having removable arms 64 which have an adjustment means 66, located at each of its extremities, connected to a respective intermediate yoke 40.

As can be seen from FIG. 5, the module-support assembly 60 while supporting the induction coil assembly 12 also allows the intermediate yokes 40 to be arranged to extend around all of the circumference of the induction coil 34 that is wound around the crucible 30. Because the intermediate yokes 40 cover the vast majority of the circumference of the induction coil 34, the amount of stray magnetic flux that might otherwise finds its way out of the confines of the furnace 10 is reduced. This advantageous covering by the intermediate yokes 40, in particular their laminates, and the induction coil 34 for the embodiment shown in FIG. 5 is about eighty percent (80%) of the total associated circumference of the wound helical induction coil 34. This shared factor of 80% is a substantial improvement of prior art furnaces; e.g., those having stud board as discussed in the "Background" in which the circumference of the wound induction coil is covered by related intermediate yokes is limited to be no more than 50% to 60%. Furthermore, as may be recognized from FIG. 5, this factor of 80% of coverage of the wound induction coil 34 may be further increased, especially if the distance separating the intermediate yokes 40A in the general area of the conduit 20B is reduced. The improvement of the coverage by the intermediate yokes 40 of the induction coil 34 provided by the present invention is in conformity with the desires of the Occupational Safety and Health Administration (OSHA) concerned with the safety of workers. More particularly, the present invention substantially reduces the amount of stray magnetic flux which might otherwise have a detrimental affect on the safety of the workers.

As can be further seen from FIG. 5, the small gaps; e.g., distance 102, are provided to allow for the individual removal of the intermediate yoke 40 from the furnace 10. Similar gaps exist between the intermediate yokes 40 and the annular upper and lower yokes 36 and 38 so as to also facilitate the removal of the intermediate yokes 40 from the induction furnace 10. For such a removal, the associated shafts 70, for example three of the associated shafts 70 for an individual intermediate yokes 40 shown most clearly in FIG. 4, need only be backed away from the associated intermediate yoke 40 and that intermediate yoke 40 is ready to be removed. If desired, two intermediate yokes 40 may be removed at one time and for such a removal, the associated arm 64 may be retracted from post 62 so as to further ease the removal of the intermediate yokes. The removal of one or more intermediate yokes 40, each having a magnetic attraction to unwanted metal debris that has found its way into the furnace, facilitates the purging of any ground faults discussed in the "Background" section. In particular, any of the intermediate yokes 40 may be removed so that the metallic debris can be cleaned therefrom or, as is sometimes common, the intermediate yoke may be removed to allow for a more convenient access to the interior of the furnace 10 so that the unwanted debris may be cleared therefrom. The ability of the present invention to facilitate the elimination of ground faults may be further enhanced by insulating the yoke bolts, such as shafts 70, so that these bolts do not become conductive members instrumental in the creation of ground faults. The quick removal of any selected intermediate yokes 40 reduces the down time typically created by unwanted metal debris. This quick removal is provided, in part, by adjustment means 66 physically supporting the intermediate yoke and both of which may be further described with reference to FIG. 6.

Figure 6:
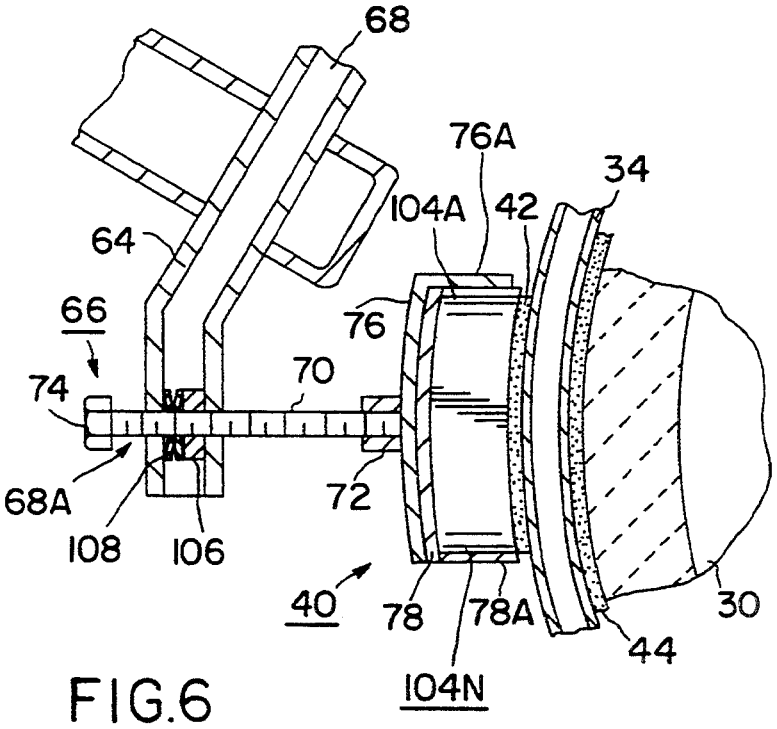
FIG. 6 illustrates further details of the module-support assembly of the induction furnace.

FIG. 6 illustrates an intermediate yoke 40 in more detail. Each intermediate yoke 40 comprises a plurality of laminates 104A . . . 104N. The arrangement of the laminates 104A . . . 104N, as well as the laminates of the upper and lower yokes 36 and 38, is similar to that described in U.S. patent application Ser. No. 08/019921. Each of the laminates 104A . . . 104N preferably comprises grain oriented electric steel having a low magnetostriction characteristic and each preferably has an axial length that is somewhat less than the predetermined distance between the upper and lower yokes 36 and 38 so as to provide gaps therebetween that facilitate the removal of the intermediate yokes 40.

The laminates 104A . . . 104N are clamped together by first and second clamping members 76 and 78 both of which cooperate with each other. The second clamping member 78 abuts against and preferably covers a portion (see FIG. 6) of the axial dimension of intermediate yoke 40 and covers all of the transverse dimension of intermediate yoke 40, as well as one of the sides of intermediate yoke 40 (as shown in FIG. 5 by segment 78A covering the outer side of laminate 104N). The first clamping member 76 is preferably attached to the guide member 72 and has a portion 76A that covers the other side of the intermediate yoke 40 in a manner similar to that described for segment 78A. The clamping members 76 and 78 preferably have portions that overlap each other and are fastened to each other by suitable means such as by welding. The clamping members 76 and 78 may have various embodiments so long as they rigidly confine and hold together the laminates 104A . . . 104N. Further, the guide means 72 need not be attached to clamp member 76, but may be attached to shaft 70 so long as the guide means allows shaft 70 to place a radially inward force against the laminates 104A . . . 104N.

The desired radial inward force is further enhanced by means of a nut 106 and conical disc spring 108 both located in the channel 68 of arm 64 and both cooperating with the shaft or bolt 70. The nut 106 holds the bolt 70 against the arm 64 by means of threaded engagement with bolt 70. The nut 106 also cooperates with the conical disc spring 108 in a manner similar to that described with reference to the tie-rod assembly 22. In addition, it should be recognized that the conical disc springs 108 may also be used for the tie-rod assembly 22 previously described. This arrangement permits radially inward force to be applied to the yokes 40 in order to prestress yokes 40 to avoid movement when the furnace is in operation. This minimizes coil vibration and acoustical noise which would otherwise result from normal operation of the furnace.

In operation, to replace a faulty intermediate yoke 40, the shafts 70 of the upper, middle and lower (see FIG. 4) of adjustment means 66 are simply retracted so that the shafts 70 move away from the guide member 72, thereby, removing the radial support of the faulty intermediate yoke 40. The faulty intermediate yoke 40 may now be easily removed from the induction furnace 10. After the faulty intermediate yoke 40 is removed, a replacement intermediate yoke 40 may be easily and conveniently installed by first positioning the replacement yoke 40 in place, relative to the helical induction coil 34, and then simply tightening the shafts 70 of the upper, middle and lower adjustment means 66 so that the replacement intermediate yoke 40 is firmly in place.

It will now be appreciated that the present invention provides for a module-support assembly 60 that allows for the intermediate yokes 40 to be quickly disconnected and reconnected. These quick disconnect-reconnect provisions of the present invention reduce the down time of the induction furnace 10 that may be otherwise typically experienced because of a faulty intermediate yoke 40 and, conversely, increases the available production time for the induction furnace 10.

The present invention also provides for the quick removal, if needed, of the complete induction coil assembly 12. For such removal, all that is necessary is to remove the crucible 30A and the refractory members 32 and either remove the intermediate yokes 40 or strap them in place. All of the shafts 70 are then backed away from their guide members 72, thereby freeing the induction coil assembly 12 from any radial support and, thereby, allowing the induction coil assembly 12 in its entirety to be removed. After such removal, the module-support assembly 60 remains connected to the stationary support members and awaits the mating of another induction coil assembly 12. Upon such mating, all that is necessary for installing the assembly 12 is to re-tighten the shafts 70 of the module-support assembly 60 and install the refractory member 32 and the crucible 30A.

The present invention may be embodied in other specific forms without departing from the spirit or essential attributes thereof and, accordingly, reference should be made to the appended claims, rather than to the foregoing specification, as indicating the scope of the invention.

What we claim is:

1. An induction furnace comprising:

(a) means for holding a material to be heated by said furnace comprising a crucible having a predetermined shape;

(b) an induction coil assembly surrounding said crucible and having a central axis, a preselected axial length and a predetermined inner diameter, said induction coil assembly comprising an induction coil, an upper yoke, a lower yoke, and a plurality of intermediate yokes spaced apart from each other, said induction coil being wound around the crucible and defining a periphery of said induction furnace, said intermediate yokes being arranged to extend around substantially all of the periphery defined by said induction coil, said upper and lower yokes being axially separated from each other and electromagnetically coupled together by said plurality of intermediate yokes; and (c) a module-support assembly surrounding and radially supporting said induction coil assembly, said module-support assembly having upright members and shaft members to allow each of said plurality of intermediate yokes to be separately removed from said induction coil assembly while the others remain in place and to allow the induction coil assembly to be removed in its entirety from said furnace.

2. An induction furnace according to claim 1, wherein said intermediate yokes extend around about 80% of the periphery defined by said induction coil so that stray magnetic flux surrounding said furnace is minimized.

3. An induction furnace according to claim 1, further comprising means for axially compressing said induction coil.

4. An induction furnace according to claim 3, wherein said axially compressing means comprises an assembly having a tie-rod and a conical disc springs, said tie-rod having means so that its opposite ends are respectively connected to said upper and lower yokes, said conical disc springs having means so as to be respectively arranged in engagement with each opposite end of said tie-rod, wherein said tie-rod and said conical disc springs allow for axial expansion of said induction coil.

5. An induction furnace according to claim 3, wherein said induction coil is prestressed by introducing internal stresses to counteract the stresses that result when said induction coil is subjected to magnetic forces, said prestressed induction coil in cooperation with said axial compressing means substantially reducing a vibration noise commonly emanating from said induction coil.

6. An induction furnace according to claim 1, wherein said upright members comprise:

(i) a first portion having a plurality of post members spaced apart from each other by a predetermined distance about the periphery of said induction furnace, each of said post members having at least one transversely extending passageway;

(ii) a second portion having a plurality of removable arm members each having at least one aperture and predetermined dimensions so as to be inserted into each of said passageways of said post members; and (iii) a plurality of adjustment means comprising said shaft members, said adjustment means being positioned in each of said apertures of said arms and located with respect to said intermediate yokes, each of said adjustment means having a movable shaft with a guiding member associated with one of its ends and a gripping member associated with its other end, each of said shafts being movable in a radial-inward direction so that each of said guiding member causes frictional engagement and pressing against a respective intermediate yoke which, in turn, presses against said induction coil.

7. An induction furnace according to claim 6, wherein each of said post members are located between a respective and adjacent pair of said plurality of intermediate yokes.

8. An induction furnace according to claim 6, wherein said predetermined dimensions of said plurality of said removable arm members are complementary to those of said passageways of said post members.

9. A module-support assembly for an induction furnace having at least an induction coil and a plurality of intermediate yokes, said module-support assembly comprising:

(i) a plurality of post members surrounding said induction furnace spaced apart from each other by a predetermined distance and, having at least one transversely extending passageway;

(ii) a plurality of removable arm members each having at least one aperture and predetermined dimensions so as to be inserted into each of said passageways of said post members;

(iii) a plurality of adjustment means that are positioned in each of said apertures of said arms and located relative to said intermediate yokes, each of said adjustment means having a movable shaft with a guiding member associated with one of its ends and a gripping member associated with its other end, each of said shafts being movable in a radially-inward direction so that each of said guiding member causes frictional engagement and pressing against a respective intermediate yoke which, in turn, presses against said coil.

10. A module-support assembly according to claim 9, wherein each of said post members are located between a respective and adjacent pair of said plurality of intermediate yokes.

* * * * *